US005938066A

United States Patent [19]

DeMars

[11] Patent Number: 5,938,066

[45] Date of Patent: Aug. 17, 1999

[54] FOOD SERVING PLATE

[76] Inventor: Robert A. DeMars, 23221 Ladrillo Ave., Woodland Hills, Calif. 91367

[21] Appl. No.: 09/061,123

[22] Filed: Apr. 16, 1998

[51] Int. Cl.[6] ..... B65D 3/00

[52] U.S. Cl. ..... 220/574.1; 206/541; 206/553; D7/505; 220/735

[58] Field of Search ..... 220/574.1, 735; 206/541, 553; D7/505

[56] References Cited

U.S. PATENT DOCUMENTS

| | | | |
|---|---|---|---|
| D. 217,632 | 5/1970 | Bouchet | D44/15 |
| 269,054 | 12/1882 | Hemsteger . | |
| 1,457,998 | 6/1923 | Norwood . | |
| 1,607,863 | 11/1926 | Betts . | |
| 1,607,864 | 11/1926 | Butler . | |
| 2,584,379 | 2/1952 | Chmielewski | 206/4 |
| 4,863,033 | 9/1989 | Buj | 206/541 |
| 5,042,712 | 8/1991 | De Roseau | 220/574.1 |
| 5,222,622 | 6/1993 | Laske, Jr. | 220/574.1 |
| 5,829,342 | 11/1998 | Lee | 220/735 |

FOREIGN PATENT DOCUMENTS

| | | | |
|---|---|---|---|
| 8324 | of 1889 | United Kingdom | 220/574.1 |

*Primary Examiner*—Joseph M. Moy
*Attorney, Agent, or Firm*—Jack C. Munro

[57] ABSTRACT

A food serving plate upon which conventional utensils, such as a spoon and fork are mounted on the upper surface of the plate. The food serving plate is intended to be used by children. The utensils are wholly confined inwardly of the exterior edge of the plate so that no portion of the utensil protrudes exteriorly of the edge of the plate. A character is displayed on the upper surface of the plate with the character being shown as holding the utensils when the utensils are mounted on the plate.

8 Claims, 1 Drawing Sheet

FIG. 1
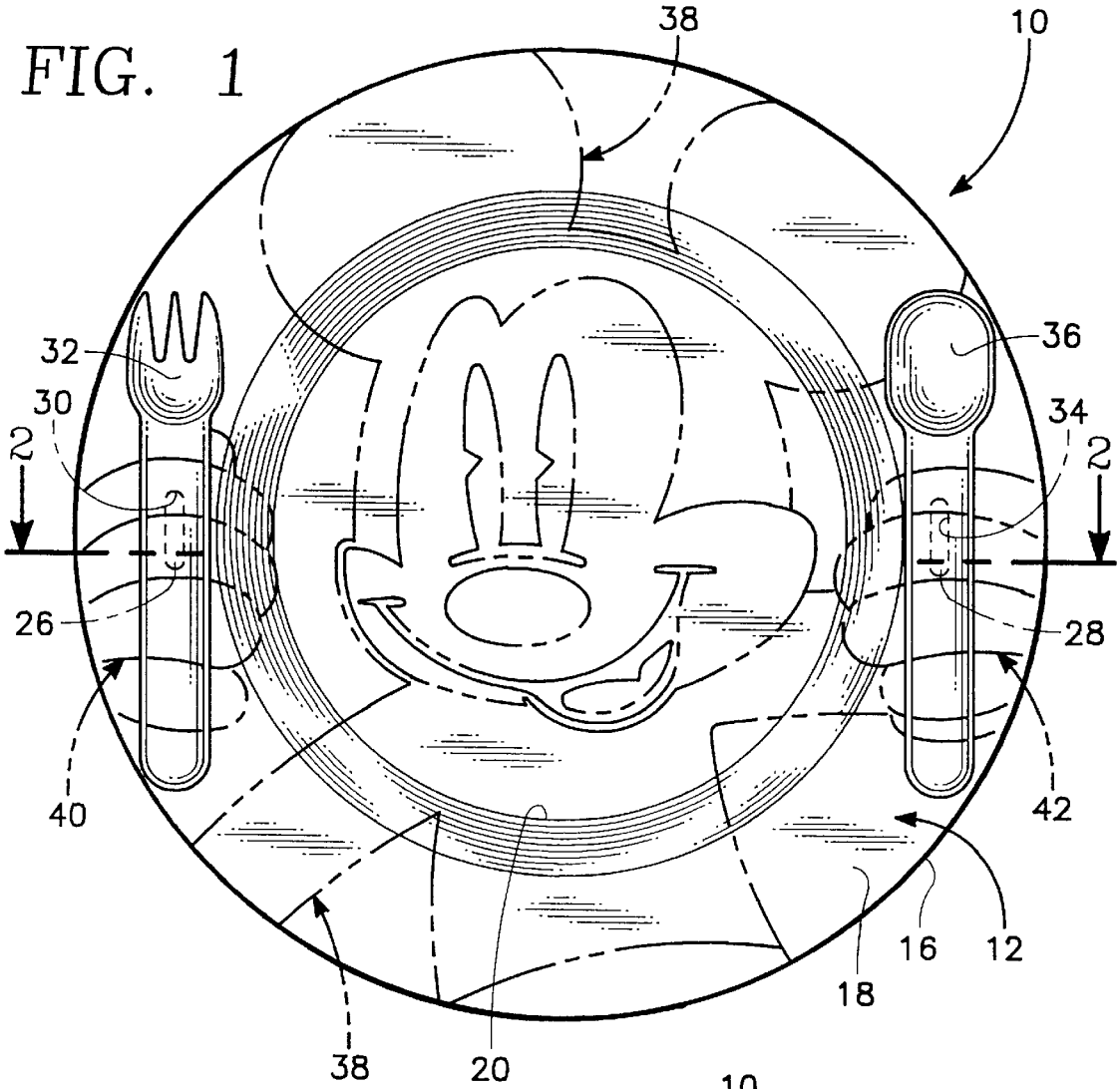
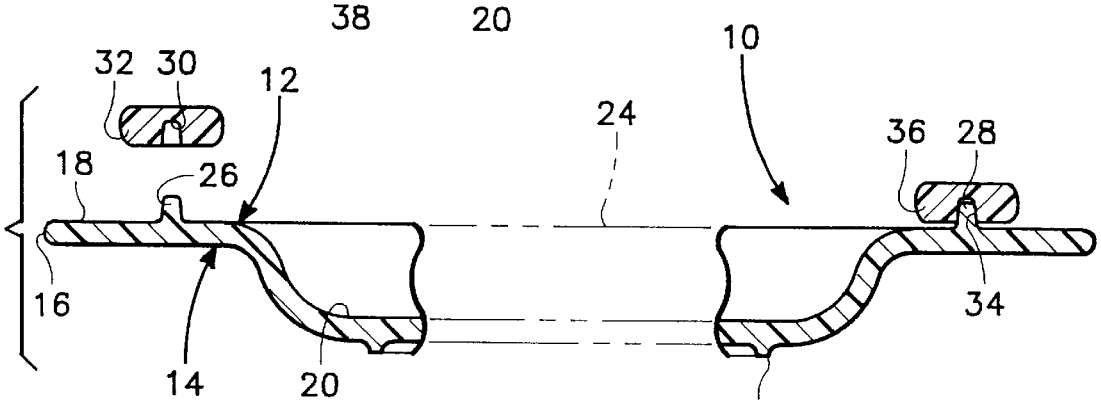
FIG. 2

FOOD SERVING PLATE

BACKGROUND OF THE INVENTION

1) Field of the Invention

The field of this invention relates to food serving devices and more particularly to an individual food serving plate that is designed to be used particularly by children.

2) Description of the Prior Art

The eating habits of western civilization generally includes utilizing a plate upon which the food is served and utensils generally in the form of a spoon, knife and fork. At times in conjunction with young children, there has been created special forms of dinnerware that encourage young children to eat in an acceptable standard utilizing conventional utensils. These prior art types of creations usually involved a spoon, knife and fork in conjunction with a bowl or plate that is intended to encourage the usage of the utensils by the small child when eating. However, there has been little effort in designing such a dinnerware and utensil combination that was "fun" for the child. Additionally, such prior art dinnerware and utensil combinations were not conducive to cleaning because of the locating of difficult to clean attachments between the dinnerware and the utensil. Another disadvantage of the prior art dinnerware and utensils has been that such have not been constructed in a manner that facilitates storage and transportability prior to being utilized.

SUMMARY OF THE INVENTION

A food serving plate which has a peripheral edge, an upper surface upon which food is to be located and a bottom surface upon which is to rest on a separate supporting surface such as a table. Mounted on the upper surface directly adjacent the peripheral edge is at least one protrusion and normally two protrusions located diametrically spaced apart relative to the plate. Each protrusion is to interlock with a recess formed within a utensil. The position of the protrusion and the length of the recess are selected so that the entire utensil is located inwardly of the peripheral edge. The upper surface of the plate is to include a character representation that appears to hold onto the utensil(s) when the utensil(s) are attached to the plate. The user is to remove each utensil from its attachment prior to usage of the utensil in conjunction with eating of the food located on the plate. The plate is constructed in a manner to facilitate stackability with the utensil(s) located in a position to not interfere with this stackability.

The primary objective of the present invention is to construct a food serving plate in conjunction with a utensil (s) that gives the impression of a happy time or fun when the child is eating from the plate.

Another objective of the present invention is to construct a food serving plate that has a utensil(s) mounted thereon with the plate and utensil combination being constructed in a manner to facilitate storage.

BRIEF DESCRIPTION OF THE DRAWING

FIG. 1 is a top plan view of the food serving plate constructed in accordance with this invention; and FIG. 2 is a cross-sectional view taken along line 2—2 of FIG. 1.

DETAILED DESCRIPTION OF THE PREFERRED EMBODIMENT

Referring particularly to the drawing, there is shown the food serving plate 10 of this invention. The food serving plate 10 has an upper surface 12 and a bottom surface 14. The food serving plate 10 will normally be constructed of a rigid material such as metal or plastic. The food serving plate 10 has a peripheral edge 16. It is to be noted that the food serving plate 10 is shown to be of circular configuration. However, it is considered to be within the scope of this invention that other configurations of plates, such as an octagonal configuration or an oval configuration, could be utilized.

The upper surface 12 includes a peripheral ledge 18. The peripheral ledge 18 is located directly adjacent the edge 16. The thickness of the peripheral ledge 18 will generally be from one to two inches. The center portion of the food serving plate 10 includes an enlarged recess 20 formed within the upper surface 18. The bottom surface 14 includes a circular ridge 22. The circular ridge 22 is to provide a resting area when the food serving plate 10 is located on a supporting surface, which is not shown. Food (not shown) is to be located within the enlarged recess 20. The peripheral ledge 18 is shown to be planer and substantially horizontal. However, the peripheral ledge 18 could be located at a slightly inclined angle relative to the horizontal axis 24.

Formed on the peripheral ledge 18 are a pair of protrusions 26 and 28. The protrusions 26 and 28 are the same size and are located diametrically opposite each other relative to the circular configuration of plate 10. Protrusion 26 is to be snugly locatable within a recess 30 formed within a first utensil 32. Protrusion 28 is to be snugly locatable within a protrusion 34 formed within a second utensil 36.

The first utensil 32 is shown in the configuration of a fork while the second utensil 36 is shown in the configuration of a spoon. However, it is to be understood that any type of utensil could be utilized such as a knife, for example, which is not shown. The first utensil 32 is removably connected to the plate 10 by means of the snug interfit between the protrusion 26 and the recess 30. In the same manner, the second utensil 36 is removably held in conjunction with the plate 10 by means of the snug interfit between the protrusion 28 and the recess 34.

One of the desirable features of the present invention is that the food serving plates 10 are to be stackable so as to facilitate storage and transportability. Also, in the designing of any kind of a transporting box, it is preferred that the utensils 32 and 36 not protrude exteriorly of the edge 16. If any portion of the utensil 32 or 36 protrudes, it may likely come into contact with an exterior structure which can result in disassembling of the stacked series of the plates 10. Therefore, the length of each of the utensils 32 and 36 is preselected so that no portion of the utensil 32 or 36 does not protrude exteriorly of the edge 16.

In order to please a child who most likely would be using the plate 10 of this invention, there is to be inscribed on the upper surface 12 indicia in the form of a character 38. The hands 40 and 42 of the character 38 are to give the appearance of grasping onto the utensils 32 and 36, respectively. This produces a pleasing image to most children. Also, the child, when using of the plate 10, is to physically remove either or both of the utensils 32 and 36 in order to utilize these utensils to consume the food that is located within the enlarged recess 20.

What is claimed is:

1. A food serving plate comprising:

an upper surface which is adapted to have deposited thereon a quantity of food, a lower surface which is adapted to rest on a supporting surface, an edge defining the periphery of said upper surface and said lower surface with said edge connecting said upper surface and said lower surface;

a first attachment means mounted on said upper surface; and a first utensil, said first utensil being located inwardly from said edge with no part of said utensil protruding exteriorly of said edge, said first utensil having second attachment means with said second attachment means to engage with said first attachment means to removably secure said first utensil to said plate, whereby said second attachment means is to be disengaged from said first attachment means permitting separation of said first utensil from said plate permitting usage of said first utensil to remove food from said upper surface.

2. The food serving plate as defined in claim 1 wherein:

said peripheral edge being in the shape of a circle forming a circular shaped food serving plate.

3. The food serving plate as defined in claim 2 wherein:

said upper surface of said plate having an enlarged recess with a peripheral ledge surrounding said enlarged recess, said peripheral ledge being raised relative to said enlarged recess, said first attachment means being mounted on said peripheral ledge, said first utensil being confined within said peripheral ledge.

4. The food serving plate as defined in claim 3 wherein:

said first attachment means comprising a recess, said second attachment means comprising a protrusion.

5. A food serving plate comprising:

an upper surface which is adapted to have deposited thereon a quantity of food, a lower surface which is adapted to rest on a supporting surface, an edge defining the periphery of said upper surface and said lower surface with said edge connecting said upper surface and said lower surface;

a first attachment means mounted on said upper surface, said first attachment means comprising a pair of spaced apart attachments;

a first utensil, said first utensil having second attachment means, said second attachment means to engage with said first attachment means to removably secure said first utensil to said plate, whereby said second attachment means is to be disengaged from said first attachment means permitting separation of said first utensil from said plate permitting usage of said first utensil to remove food from said upper surface;

there being a second utensil mounted on said upper surface, said second utensil having third attachment means, said third attachment means to engage with said first attachment means to removably secure said second utensil to said plate, whereby said third attachment means is to be disengaged from said first attachment means permitting separation of said second utensil from said plate permitting usage of said second utensil to remove food from said upper surface, said second utensil being spaced from said first utensil; and a character representation being displayed on said upper surface, said character representation giving the impression of holding said first utensil and said second utensil when said first utensil and said second utensil are mounted on said upper surface.

6. The food serving plate as defined in claim 5 wherein:

both said first utensil and said second utensil being located inwardly from said edge with no part of said first utensil and said second utensil protruding exteriorly of said edge.

7. The food serving plate as defined in claim 6 wherein:

said upper surface of said plate having an enlarged recess with a peripheral ledge surrounding said enlarged recess, said peripheral ledge being raised relative to said enlarged recess, said first attachment means being mounted on said peripheral ledge.

8. The food serving plate as defined in claim 7 wherein:

said first attachment means comprising a pair of spaced apart protrusions, said second attachment means comprising a recess formed within said first utensil, said third attachment means comprising a recess formed within said second utensil, said pair of protrusions mounted on said peripheral edge.

* * * * *